US005470270A

United States Patent [19]

Beamon, Jr. et al.

[11] Patent Number: 5,470,270

[45] Date of Patent: Nov. 28, 1995

[54] DOLL WITH BABY-HUGGING CAPABILITIES

[76] Inventors: Cecil H. Beamon, Jr.; Linda L. Beamon, both of 603 Stoneview Trail, Lilburn, Ga. 30247

[21] Appl. No.: 344,013

[22] Filed: Nov. 23, 1994

[51] Int. Cl.[6] ..... A63H 13/00

[52] U.S. Cl. ..... 446/354; 446/330

[58] Field of Search ..... 446/330, 354, 446/298, 334, 336

[56] References Cited

U.S. PATENT DOCUMENTS

| | | | |
|---|---|---|---|
| 2,614,365 | 10/1952 | Musselwhite et al. | 446/330 |
| 3,053,008 | 9/1962 | Pelunis | 446/330 |
| 4,911,676 | 3/1990 | Fan | 446/330 X |
| 5,378,188 | 1/1995 | Clark | 446/330 |

*Primary Examiner*—Mickey Yu

[57] ABSTRACT

A doll with baby-hugging capabilities having a main body portion with a chest and with arms extending outwardly therefrom; a motion imparting mechanism within the doll having a horizontally-disposed central plate, the plate having a forward end with a shield positionable in the chest area of the doll; a secondary plate positioned beneath the central plate, the secondary plate being adapted to move toward and away from the shield upon the application of forces to the rear surface of the secondary plate; a pair of similarly-shaped squeezer arms in an L-shaped configuration with short interior segments and long exterior segments positioned in the arms of the doll; first pivot pins securing the interior ends of the squeezer arms to the central plate adjacent to its rearward edges thereof for rotational movement with respect thereto, the apertures in the L-shaped plates being elongated; and secondary pivot pins securing the central sections of squeezer arms to the lower plate.

3 Claims, 4 Drawing Sheets

DOLL WITH BABY-HUGGING CAPABILITIES

BACKGROUND OF THE INVENTION

1. Field of the Invention

The present invention relates to a doll with baby-hugging capabilities and more particularly pertains to providing a doll having arms with internal mechanisms that enable the doll to move its arms into a hugging position with respect to the baby when squeezed or hugged.

2. Description of the Prior Art

The use of dolls of a wide variety of designs and configurations is known in the prior art. More specifically, dolls of a wide variety of designs and configurations heretofore devised and utilized for the purpose of providing dolls with mechanical capabilities of a wide variety of designs and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,057,928, an articulated doll.

U.S. Pat. No. 4,212,132, discloses a doll with embracing arm movement.

U.S. Pat. No. 4,280,292, discloses a torso and display-supportable puppet.

U.S. Pat. No. 4,287,681, discloses a toy doll and accessory.

U.S. Pat. No. 4,601,671, discloses a huggable toy mechanism.

In this respect, the doll with baby-hugging capabilities according to the present invention substantially departs from the conventional concepts and designs of the prior art, and in doing so provides an apparatus primarily developed for the purpose of providing a doll having arms with internal mechanisms that enable the doll to move its arms into a hugging position with respect to the baby when squeezed or hugged.

Therefore, it can be appreciated that there exists a continuing need for a new and improved doll with baby-hugging capabilities which can be used for providing a doll having arms with internal mechanisms that enable the doll to move its arms into a hugging position with respect to the baby when squeezed or hugged. In this regard, the present invention substantially fulfills this need.

SUMMARY OF THE INVENTION

In view of the foregoing disadvantages inherent in the known types of dolls of a wide variety of designs and configurations now present in the prior art, the present invention provides an improved doll with baby-hugging capabilities. As such, the general purpose of the present invention, which will be described subsequently in greater detail, is to provide a new and improved doll with baby-hugging capabilities and method which has all the advantages of the prior art and none of the disadvantages.

To attain this, the present invention essentially comprises a new and improved doll with baby-hugging capabilities comprising, in combination, a doll having a main body portion with a chest and with arms extending outwardly therefrom; a motion imparting mechanism within the doll comprising a horizontally-disposed central plate, the plate having a forward end with a shield positionable in the chest area of the doll and adapted to be positioned adjacent the chest of a child playing with the doll; a secondary plate positioned beneath the central plate, the secondary plate being adapted to move toward and away from the shield upon the application of forces to the rear surface of the secondary plate; a pair of similarly-shaped squeezer arms secured in an L-shaped configuration with short interior segments and long exterior segments positioned in the arms of the doll; first pivot pins securing the interior ends of the L-shaped member to the central plate adjacent to its rearward edges thereof for rotational movement with respect thereto, the apertures in the L-shaped plates being elongated; secondary pivot pins securing the central sections of the L-shaped member to the lower plate whereby when the lower plate is moved toward the shield, the long exterior segments of the arms will move inwardly about the interior pivot pins; and a reciprocable rod positioned between the shield and the electrical sensor with a spring tending to urge the shield away from the electrical sensor, the electrical sensor being operated by the axial movement of the shield toward the electrical component to generate a signal to rotate a solenoid, the solenoid adapted to reciprocate the secondary plate toward and away from the shield to effect the rotational movement of the L-shaped member to effect a hug by the doll to the child with its chest against the chest of the doll and the shield when effecting a squeezing motion thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved doll with baby-hugging capabilities which has all the advantages of the prior art dolls of a wide variety of designs and configurations and none of the disadvantages.

It is another object of the present invention to provide a new and improved doll with baby-hugging capabilities which may be easily and efficiently manufactured and marketed.

It is further object of the present invention to provide a new and improved doll with baby-hugging capabilities which is of durable and reliable construction.

An even further object of the present invention is to provide a new and improved doll with baby-hugging capabilities which is susceptible of a low cost of manufacture with regard to both materials and labor, and which accordingly is then susceptible of low prices of sale to the consuming public, thereby making such doll with baby-hugging capabilities economically available to the buying public.

Still yet another object of the present invention is to provide a new and improved doll with baby-hugging capabilities which provides in the apparatuses and methods of the prior art some of the advantages thereof, while simultaneously overcoming some of the disadvantages normally associated therewith.

Still another object of the present invention is to provide a doll having arms with internal mechanisms that enable the doll to move its arms into a hugging position with respect to the baby when squeezed or hugged.

Lastly, it is an object of the present invention to provide a new and improved doll with baby-hugging capabilities comprising a doll having a main body portion with a chest and with arms extending outwardly therefrom; a motion imparting mechanism within the doll comprising a horizontally-disposed central plate, the plate having a forward end with a shield positionable in the chest area of the doll; a secondary plate positioned beneath the central plate, the secondary plate being adapted to move toward and away from the shield upon the application of forces to the rear surface of the secondary plate; a pair of similarly-shaped squeezer arms secured in an L-shaped configuration with short interior segments and long exterior segments positioned in the arms of the doll; first pivot pins securing the interior ends of the L-shaped member to the central plate adjacent to its rearward edges thereof for rotational movement with respect thereto, the apertures in the L-shaped plates being elongated; and secondary pivot pins securing the central sections of the L-shaped member to the lower plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
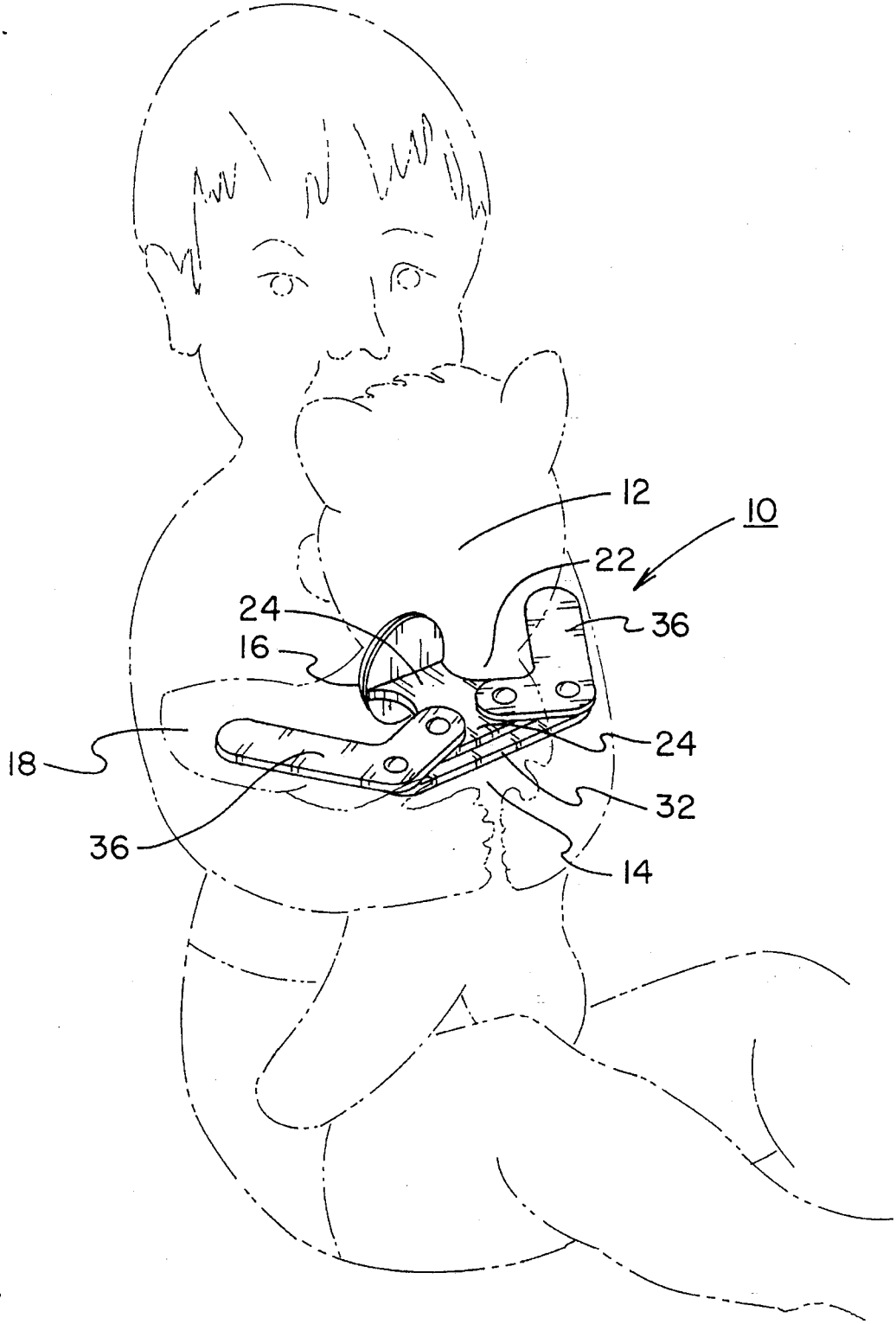
FIG. 1 is a perspective view of the preferred embodiment of the new and improved doll with baby-hugging capabilities constructed in accordance with the principles of the present invention.
Figure 2:
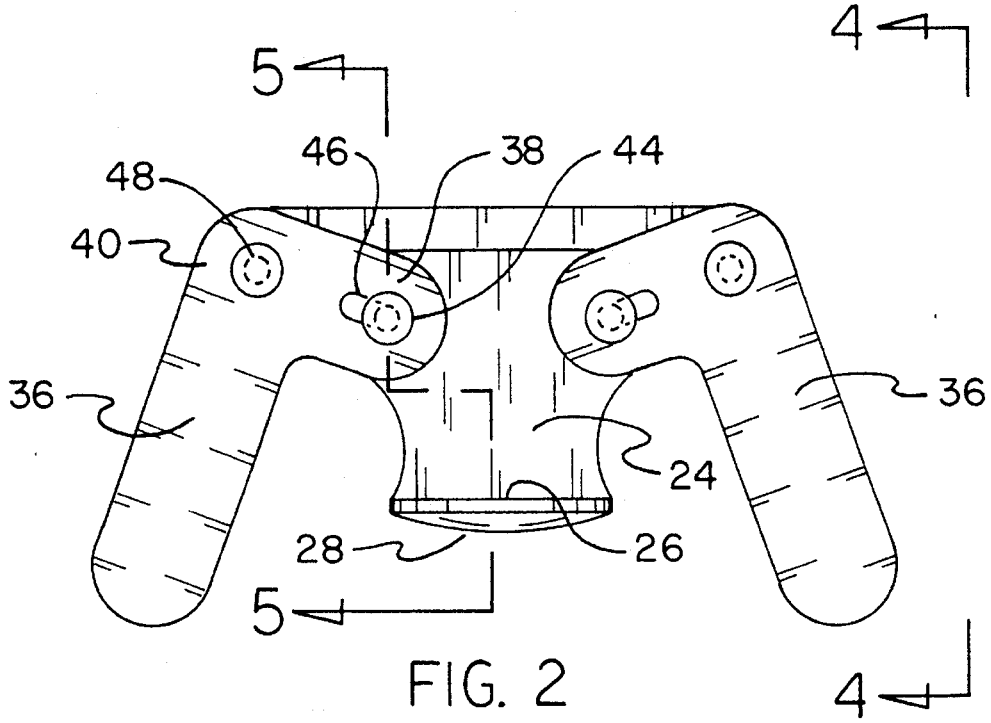
FIG. 2 is a top elevational view of the mechanisms shown in FIG. 1.
Figure 3:
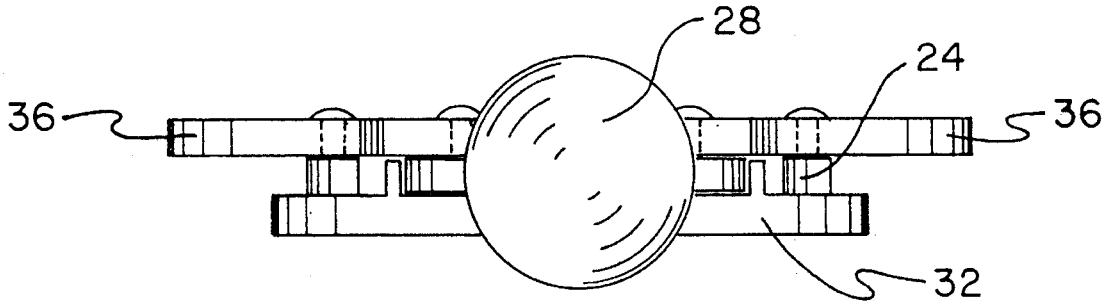
FIG. 3 is a front view of the mechanisms shown in FIGS. 1 and 2.
Figure 4:
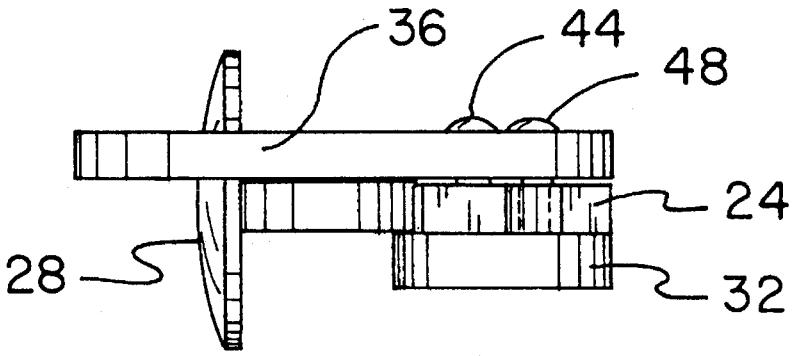
FIG. 4 is an end elevational view taken along line 4—4 of FIG. 2.
Figure 5:
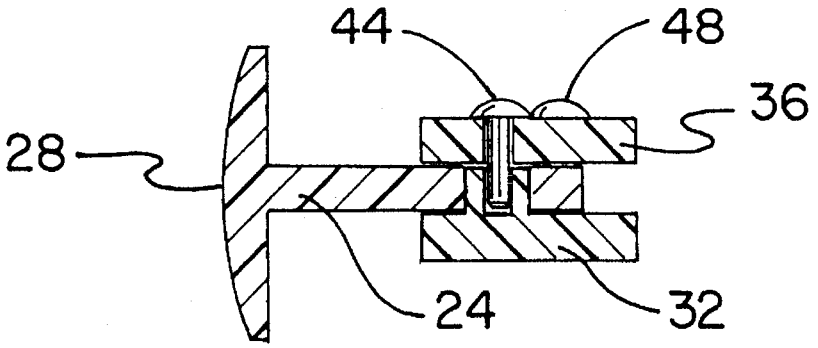
FIG. 5 is cross-sectional view taken along line 5—5 of FIG. 2.

With reference now to the drawings, and in particular to FIG. 1 thereof, the preferred embodiment of the new and improved doll with baby-hugging capabilities embodying the principles and concepts of the present invention and generally designated by the reference numeral 10 will be described.

The present invention, the new and improved doll with baby-hugging capabilities, is a system 10 comprised of a plurality of components. Such components, in their broadest context, include a doll, a motion imparting mechanism, a secondary plate, squeezer arms, first pivot pins, secondary pivot pins, and, in an alternate embodiment, a reciprocable arm with a solenoid. Such components are individually configured and correlated with respect to each other so as to attain the desired objective.

The central component of the system 10 of the present invention is a doll 12. The doll has a main body portion 14 with a chest 16 and with arms 18 extending outwardly therefrom.

Within the doll is a motion imparting mechanism 22. The motion imparting mechanism ,comprises a horizontally disposed central plate 24. Such centrally disposed plate has a forward end 26. A shield 28 is in the plate and is positionable on the chest area of the doll. The plate is adapted to be positioned adjacent the chest of a child playing with the doll.

Also within the doll is a secondary plate 32. The secondary plate is positioned beneath the central plate. The secondary plate is adapted to move toward and away from the shield upon the application of forces to the rear surface of the secondary plate.

Next provided are a pair of similarly-shaped squeezer arms 36. Such squeezer arms are secured in an L-shaped configuration. The L-shaped configuration includes short interior segments 38 and long exterior segments 40. The long interior segments are secured within the arms of the doll.

First pivot pins 44 secure the interior of the L-shaped members to the central plate. Such securement is adjacent to its rearward edges. This allows for rotational movement of the L-shaped members with respect to the plate to which it is secured. There are provided apertures 46 in the L-shaped plate. Such apertures are elongated to allow for the appropriate movement. In addition to the first pivot pins are secondary pivot pins 48. The secondary pivot pins are secured to the central sections of the L-shaped member and coupled to the lower plate. In this manner, when the lower plate is moved toward the shield, the long exterior segments of the arms will move inwardly. Such movement is about the interior pivot pins. This affects the feeling of a doll hugging the baby which is hugging the doll.

Figure 6:
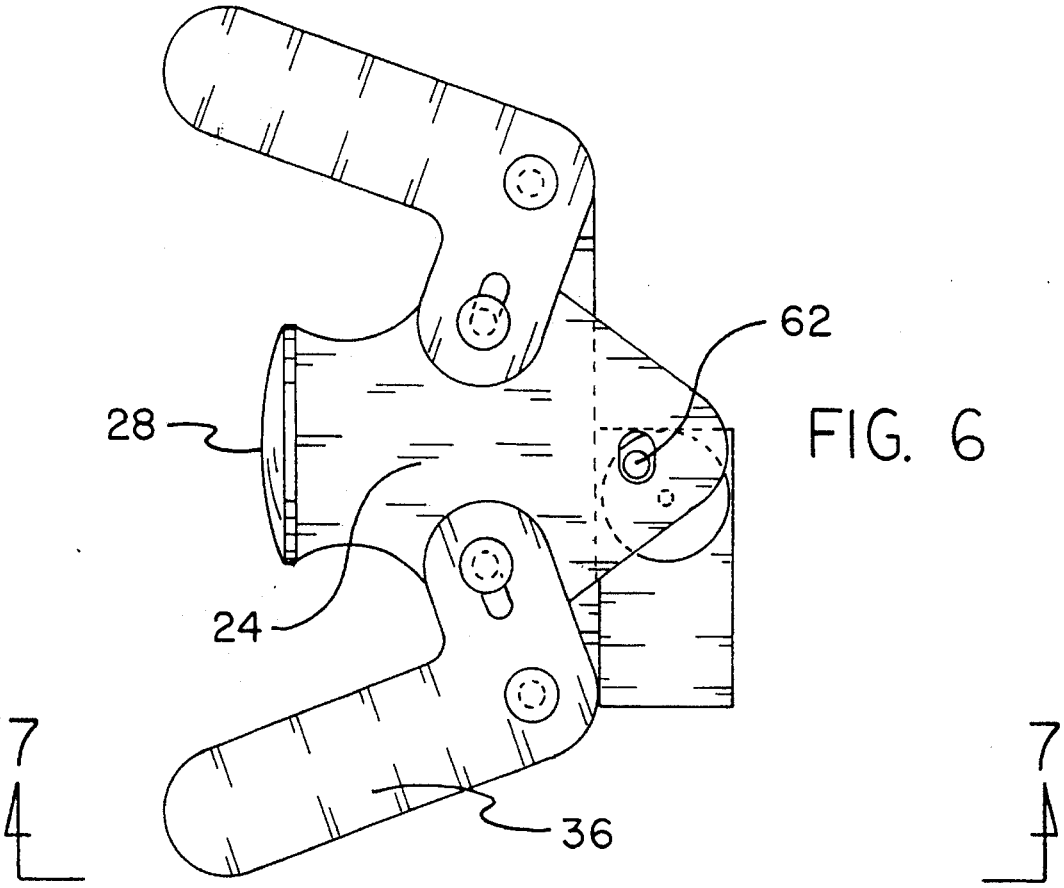
FIG. 6 is a view similar to FIG. 2 but showing an alternate embodiment of the invention.
Figure 7:
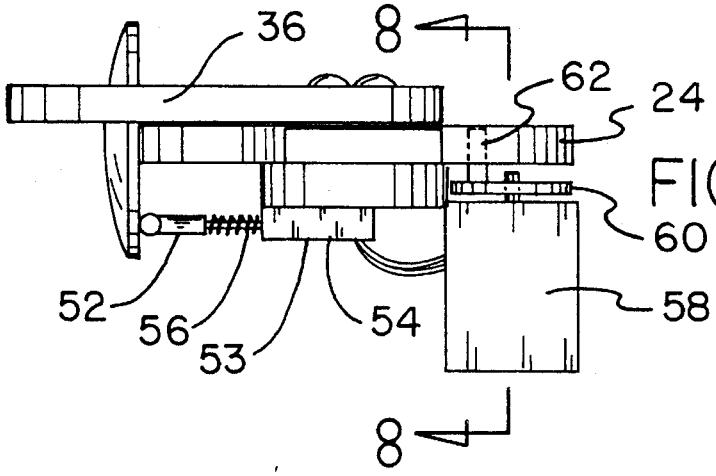
FIG. 7 is an end elevational view taken along line 7—7 of FIG. 6.
Figure 8:
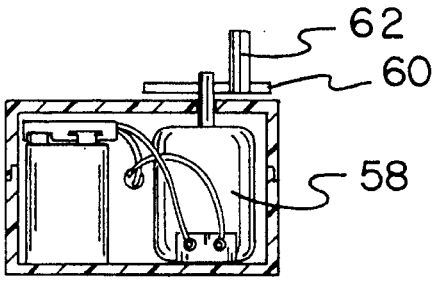
FIG. 8 is a cross-sectional view taken along line 8—8 of FIG. 7.

In an alternate embodiment of the invention as shown in FIGS. 6, 7 and 8, a reciprocable rod 52 is positioned between the shield and a lower plate 53. An electrical sensor 54 is provided. The rod has a spring 56 tending to urge the shield away from the electrical sensor. The electrical sensor is operated by the axial movement of the shield toward the electrical component. This action functions to generate a signal. Such signal functions to rotate a solenoid 58. The solenoid is adapted to rotate the secondary plate 60 to oscillate on pin 62 to move plate 24 toward and away from the shield. This, an electrical embodiment, effects the rotational movement of the L-shaped member. In this manner, a hug is provided by the doll to the child with its chest against the chest of the doll and the shield thereby effecting a squeezing motion from the doll to the child.

The present invention comprises a doll or stuffed animal which consists of inner mechanical or electrical components that enable it to move its arms into a hugging position when squeezed or hugged.

This doll may be produced from a durable soft outer material. The inner mechanisms, which enable it to move in an embracing position, include pivoting plastic components within the arms and small hinges at the elbows. These components are operated either manually, utilizing outside pressure to manipulate the arms, or electrically in which an outer switch is maneuvered to initiate a small motor to control the hugging movement. A variety of attractive doll and animal styles could be produced as well as various sizes to accommodate children of all ages.

The present invention mechanically operated doll utilizes outside pressure to move the arms. The child simply presses against the doll to force the plastic components within the arms to move in toward the child in a hugging movement. The electrically operated doll features a small outer on/off switch which controls the pivoting action of the arms and elbows to end in the hugging position. Both styles are designed to wrap its arms around the child so that he/she feels gently hugged by the doll.

The present invention is a unique doll or animal which provides a child with gentle lifelike and loving embraces. Its variety of designs and styles should appeal to boys and girls of all ages and offers a child an added comfortable sense of security.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved doll with baby-hugging capabilities comprising, in combination:

a doll having a main body portion with a chest and with arms extending outwardly therefrom;

a motion imparting mechanism within the doll comprising a horizontally-disposed central plate, the central plate having a rearward end and a forward end with an axially movable shield positionable in the chest area of the doll and adapted to be positioned adjacent the chest of a child playing with the doll;

a secondary plate positioned beneath the central plate, the secondary plate having a front surface and a rear surface being adapted to move toward and away from the shield upon the application of forces to the rear surface of the secondary plate;

a pair of similarly-shaped squeezer arms in an L-shaped configuration with short interior segments terminating at interior ends with apertures thereadjacent and with long exterior segments and with central sections therebetween positioned in the arms of the doll;

first pivot pins securing the interior ends of the squeezer arms to the central plate adjacent to its rearward end for rotational movement of the squeezer arms with respect to the central plate, the apertures in the squeezer arms being elongated;

secondary pivot pins securing the central sections of the squeezer arms to the lower plate whereby when the lower plate is moved toward the shield, the long exterior segments of the arms will move inwardly about the first pivot pins; and an electrical sensor within the main body portion with a reciprocable rod positioned between the shield and the electrical sensor and with a spring tending to urge the shield away from the electrical sensor, the electrical sensor being operated by the axial movement of the shield toward the electrical sensor to generate a signal to rotate a solenoid, the solenoid adapted to reciprocate the secondary plate toward and away from the shield to effect the rotational movement of the squeezer arms to effect a hug by the doll to the child with its chest against the chest of the doll and the shield when effecting a squeezing motion thereto.

2. A doll with baby-hugging capabilities comprising:

a doll having a main body portion with a chest and with arms extending outwardly therefrom;

a motion imparting mechanism within the doll comprising a horizontally-disposed central plate, the central plate having a rearward end and a forward end with an axially movable shield positionable in the chest area of the doll;

a secondary plate positioned beneath the central plate, the secondary plate having a front surface and a rear surface being adapted to move toward and away from the shield upon the application of forces to the rear surface of the secondary plate;

a pair of similarly-shaped squeezer arms in an L-shaped configuration with short interior segments terminating at interior ends with apertures thereadjacent and with long exterior segments and with central sections therebetween positioned in the arms of the doll;

first pivot pins securing the interior ends of the squeezer arms to the central plate adjacent to its rearward end for rotational movement of the squeezer arms with respect to the central plate, the apertures in the squeezer arms being elongated; and secondary pivot pins securing the central sections of the squeezer arms to the lower plate.

3. The device as set forth in claim 2 and further including:

an electrical sensor within the main body portion with a reciprocable rod positioned between the shield and the electrical sensor and with a spring tending to urge the shield away from the electrical sensor, the electrical sensor being operated by the axial movement of the shield toward the electrical sensor to generate a signal to rotate a solenoid, the solenoid adapted to reciprocate the secondary plate toward and away from the shield to effect the rotational movement of the squeezer arms to effect a hug by the doll to the child with its chest against the chest of the doll and the shield when effecting a squeezing motion thereto.

* * * * *